US009085023B2

(12) United States Patent
Danhash et al.

(10) Patent No.: US 9,085,023 B2
(45) Date of Patent: Jul. 21, 2015

(54) SWINGING HEAD SWAGE TOOL

(75) Inventors: May Danhash, Los Angeles, CA (US); Luis Arturo Chavez, Los Angeles, CA (US); Jeffrey Adam Lloyd Ackermann, Norco, CA (US)

(73) Assignee: DMC POWER, INC., Gardena, CA (US)

( * ) Notice: Subject to any disclaimer, the term of this patent is extended or adjusted under 35 U.S.C. 154(b) by 77 days.

(21) Appl. No.: 13/553,558

(22) Filed: Jul. 19, 2012

(65) Prior Publication Data

US 2014/0020226 A1 Jan. 23, 2014

(51) Int. Cl.
*B21D 39/04* (2006.01)

(52) U.S. Cl.
CPC ..... *B21D 39/04* (2013.01); *B21D 39/046* (2013.01); *Y10T 29/4984* (2015.01); *Y10T 29/53987* (2015.01)

(58) Field of Classification Search
CPC ..... B25B 27/10; Y10T 29/5367; Y10T 29/53987; B21D 39/04; B21D 37/02; B21D 37/04; B21D 37/06; B21D 37/12; B30B 15/026; B30B 39/048
USPC ..... 29/237; 72/402
See application file for complete search history.

(56) References Cited

U.S. PATENT DOCUMENTS

| | | | | |
|---|---|---|---|---|
| 5,069,058 | A * | 12/1991 | Hyatt | 72/413 |
| 5,335,530 | A * | 8/1994 | Homm | 72/402 |
| 5,353,623 | A * | 10/1994 | Bobenhausen | 72/402 |
| 6,324,884 | B1 * | 12/2001 | Barjesteh et al. | 72/402 |
| 6,484,552 | B1 * | 11/2002 | Bernas et al. | 72/402 |
| 6,923,037 | B2 * | 8/2005 | Bowles et al. | 72/416 |
| 7,299,674 | B2 * | 11/2007 | Palejwala et al. | 72/402 |
| 7,788,779 | B2 * | 9/2010 | Frenken | 29/237 |
| 8,336,177 | B2 * | 12/2012 | Vernasca et al. | 29/237 |
| 8,381,645 | B2 * | 2/2013 | Hejplik | 100/269.01 |
| 2002/0056307 | A1 * | 5/2002 | Ertl et al. | 72/402 |
| 2005/0044924 | A1 * | 3/2005 | Dole | 72/402 |
| 2008/0276683 | A1 * | 11/2008 | Frenken | 72/402 |
| 2014/0007642 | A1 * | 1/2014 | Westley et al. | 72/402 |

FOREIGN PATENT DOCUMENTS

WO WO 2011069652 A1 * 6/2011

* cited by examiner

*Primary Examiner* — Lee D Wilson
*Assistant Examiner* — Jamal Daniel
(74) *Attorney, Agent, or Firm* — DLA Piper LLP (US)

(57) ABSTRACT

A swage tool includes a first die coupled to a portion of a first die block and a second die coupled to a portion of a second die block. A cylinder moves the second die toward the first die. The first die block rotates about a longitudinal axis of the first die block.

20 Claims, 15 Drawing Sheets

SWINGING HEAD SWAGE TOOL

BACKGROUND OF THE INVENTION

1. Field of the Invention

This invention relates to a swinging head swage tool and a method of assembly thereof.

2. Description of Related Art

Swaged fittings are known for connecting ends of tubes together to form fluid-tight connections between tubes. A swage tool is used to swage fittings to a tube. During a swaging operation, the fitting is compressed radially inwardly by the swaging tool. This causes annular ridges on the outer surface of the fitting to be flattened and transferred to its inner surface. As a result, annular indentations are formed in the tube, and thereby attach it securely to the fitting. In a prior art swage tool, such as disclosed in U.S. Pat. No. 5,069,058, head 60 of swaging tool 10 is slideably attached and removed from cylinder 53 by a tongue and groove configuration on the head and cylinder, respectively. However, over time the vibration between the head and the cylinder during swaging will wear down the swage tool, reduce performance and require replacement, especially at the location where the tongues fit within the grooves to connect the head to the cylinder. In particular, because of the slight clearance between the mating surfaces of the tongues and grooves that allow relative sliding movement for assembly, those surfaces will become roughened over time. Consequently, there is also a tendency for the lower die to rotate and wobble during swaging operations. Die rotation or wobble can damage the swaging tool and result in a defectively swaged fitting. Thus, conventional swage tools can become unreliable.

The prior art suffers from the problem that repeated use of the swaging tool causes the tool to wear, especially at a location where the tongues fit the groove. Over time, the surfaces will become roughened to the point where either one or both of the head and the cylinder portions need to be replaced entirely. Assembling and setting a workpiece in the swage tool is also cumbersome.

SUMMARY OF THE INVENTION

The present invention provides a swinging head swage tool that is quickly and easily assembled and operated. The invention is preferably utilized in electrical power and aerospace applications, but is not limited to these fields and may be utilized in any type of swaging. For example, the invention is used in electrical power trenching applications and can be used in high tension aerial installations as well. The swage tool may also be implemented as a bench mounted tool. The invention is also scalable in size for different applications.

One embodiment of the invention is a swage tool including a first die coupled to a portion of a first die block and a second die coupled to a portion of a second die block. A cylinder moves the second die toward the first die. The first die block rotates about a longitudinal axis of the first block. First and second arms couple the first die block to the cylinder. A set of pins are inserted through the cylinder and the second arm to couple the first die block to the cylinder. The first arm is coupled to the second arm via the first die block. The second arm rotates about the longitudinal axis of the first die block. The first die block and the second arm rotate independently. A main pin is provided through the first arm, the second arm and the first die block. The first die block includes a main pin is inserted through a cylindrical portion. The first and second arms include a ball detent and spring. The first die block includes a pair of grooves corresponding to the ball detent. A piston of the cylinder is connected to a connecting portion of the second die. Alternatively, a first arm and a second arm couples the first die block to the cylinder and a set of swingable tabs secures the first arm and the second arm to the cylinder. The first arm include a first push pin and the first die block includes a first spring and a first ram in contact with the first push pin. The second arm includes a second push pin and the first die block includes a second spring and a second ram in contact with the second push pin. The first arm and the first die block are locked at a first predetermined position when the first push pin protrudes from the first arm, and the second arm and the die block are locked at a second predetermined position when the second push pin protrudes from the second arm.

Another embodiment of the invention is a method of assembling a swage tool including the steps of coupling a first die to a first die block and a second die to a second die block. A cylinder is coupled to the second die block. A first arm is coupled to the cylinder through a first set of pins. The first arm is coupled to the first die block. The first die block is coupled to a second arm. The first die block is rotated about a longitudinal axis of the first die block. The second arm is rotated about the longitudinal axis of the first die block. The second arm is coupled to the cylinder through a second set of pins. A main pin is inserted through the first arm, the first die block and the second arm to couple the die block to the first and second arms. The first die block and the second arm rotate independently. The first die block rotates 360 degrees. The second set of pins are inserted and removed by hand without a tool. The first arm is locked to the first die block via a ball detent and spring of the first arm. The second arm is locked to the first die block via a ball detent and spring of the second arm. The first die is coupled to the first die block by a first retaining plate. The second die is coupled to the second die block by a second retaining plate. The cylinder is coupled to the second die block by pushing in a spring-loaded plate of the second die block to allow insertion of the cylinder into an interior cavity of the second die block. The plate is released to secure the cylinder in the second die block.

In yet another embodiment of the invention a method of assembling a swage tool includes the steps of coupling a first die to a first die block and a second die to a second die block. A cylinder is coupled to the second die block. A first arm is coupled to the cylinder through a first set of pins and a first set of swingable tabs. The first arm is coupled to the first die block. The first die block is coupled to a second arm. The first die block is rotated about a longitudinal axis of the first die block. The second arm is rotated about the longitudinal axis of the first die block. The second arm is coupled to the cylinder through a second set of swingable tabs. The second arm is attached to the cylinder by depressing a push pin of the first arm, rotating the second arm, and rotating the second set of tabs to contact the second arm. The first arm is locked to the first die block at a first predetermined position when a first push pin of the first arm protrudes from the first arm. The second arm is locked to the first die block at a second predetermined position when a second push pin of the second arm protrudes from the second arm.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
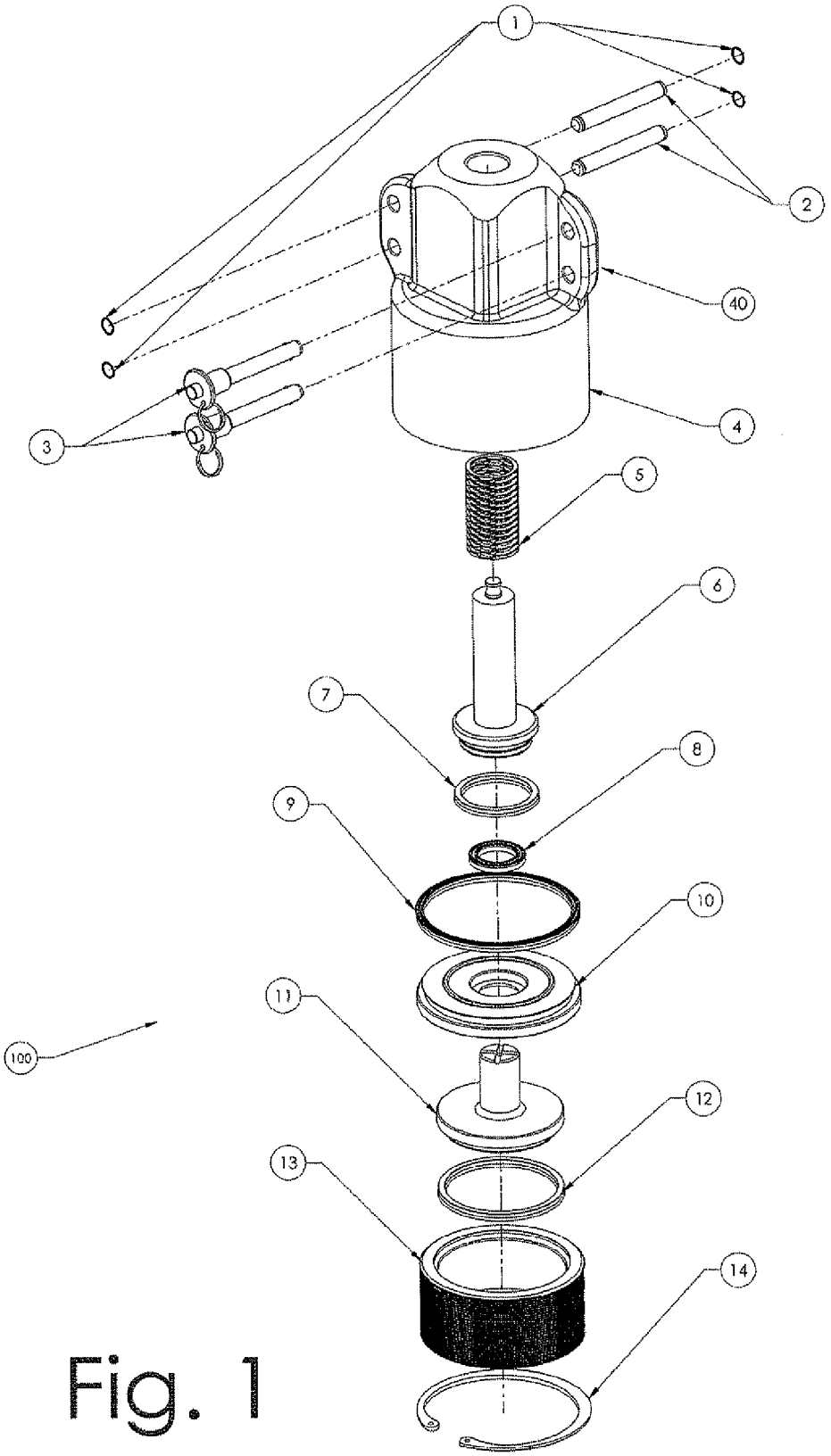
FIG. 1 is an exploded perspective view of a cylinder assembly portion of a swage tool according to the invention.

FIGS. 1-8 illustrate a swinging head swage tool according to the present invention for swaging a fitting to join tubes together. The swinging head swage tool is formed with cylinder assembly portion 100 and head assembly portion 200. FIG. 1 shows an exploded perspective view of a cylinder portion according to one embodiment of the invention. Cylinder 4 houses elements 5-14 and is formed of a composite material to reduce weight. Cylinder 4 is also scalable for different-sized pistons and to allow arms 17 to be provided closer or farther to each other. Cylinder 4 is provided to compress a pair of dies 26 toward each other to swage a workpiece therebetween. On the exterior of cylinder 4, a set of attachment portions 40 are provided to secure first and second arms (not shown in FIG. 1) to cylinder 4. Attachment portions 40 protrude out from cylinder 4. Attachment portions 40 include holes for the insertion of either bracket pins or quick release pins. FIG. 1 illustrates two attachment portions 40, but as seen in FIGS. 7*a* and 7*b*, a pair of attachment portions are provided on one side of the cylinder for one arm while the other arm includes only one attachment portion. The attachment portions include holes to accommodate either bracket pins 2 or quick-release pins 3 where a pair of attachment portions are provided for bracket pins 2 but just one attachment portion is provided for quick-release pins 3. The use of pins 2 and 3 will be discussed in more detail later.

Figure 5A:
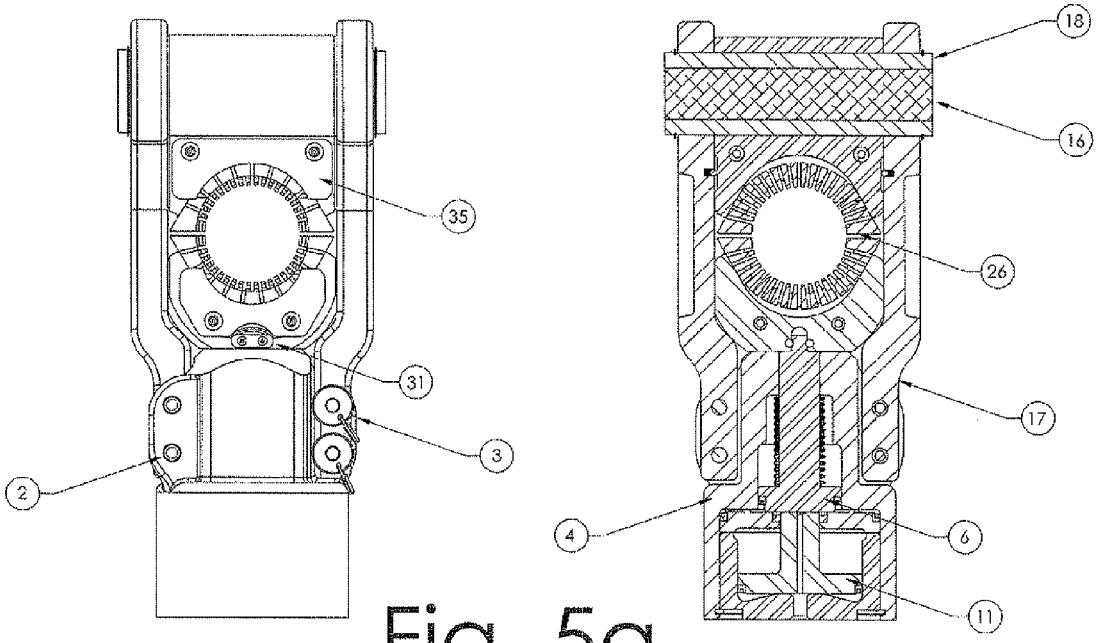
FIG. 5*a* is a side and cross-sectional view of the swage tool in an unswaged position.
Figure 5B:
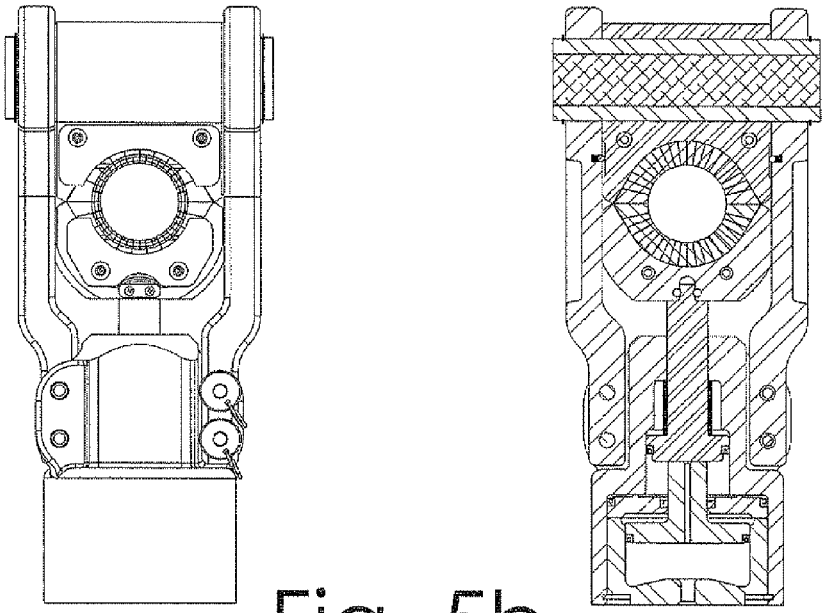
FIG. 5*b* is a side and cross-sectional view of the swage tool in a swaged position.

Wave spring 5 is provided over upper piston 6. Wave spring 5 compresses and expands based on the movement of upper piston 6. The use of wave spring 5 advantageously reduces the size, and thereby the weight, of cylinder 4 over swage tools using conventional helix springs. Upper piston 6 is slid through the center of spring 5 and the uppermost hole in cylinder 4 in order to couple with and push up second die block assembly 36 (FIG. 2) between unswaged and swaged positions (FIGS. 5*a* and 5*b*). Upper piston 6 includes on its bottom surface upper piston seal 7. Cylinder 4 is divided into upper and lower chambers by divider 10. Divider 10 includes divider seal 9. Upper piston 6 is a rod that slidably extends through the bore of cylinder 4 for connection to second die block 36. Lower piston 11 moves within the lower chamber and slidably extends through a bore in divider 10 so as to abut upper piston 6. The two pistons are biased to return position by wave spring 5. The pair of pistons within cylinder 4 moves lower second die block assembly 36 towards upper first die block assembly 35 to swage the workpiece.

At an unswaged position (i.e. FIG. 5*a*), upper piston 6 sits above the divider. Divider 10 is formed with rod seal 8 and divider seal 9 provided around a circumference of divider 10 (FIG. 1). Threaded bottom cap 13 is provided below divider 10 and is screwed into the bottom of cylinder 4 along with snap ring 14. Lower piston 11 includes lower piston seal 12 and moves up and down through a hole in divider 10 to move upper piston 6, which in turn moves dies 26 closer together.

The pair of quick-release pins 3 is provided for slidable insertion and removal through second arm 17 and attachment portion 40. Pins 3 are easily inserted and removed by hand without any tools so as to allow the user to quickly rotate second arm 17 and first die block assembly 35. A surface is provided for a user to grip and pull out the inserted pin on one end of pin 3. By contrast, bracket pins 2 are secured through first arm 17 and attachment portions 40 by snap rings 1. Bracket pins 2 are not easily removed by hand and are meant to ensure secure coupling between cylinder 4 and first arm 17.

Figure 2:
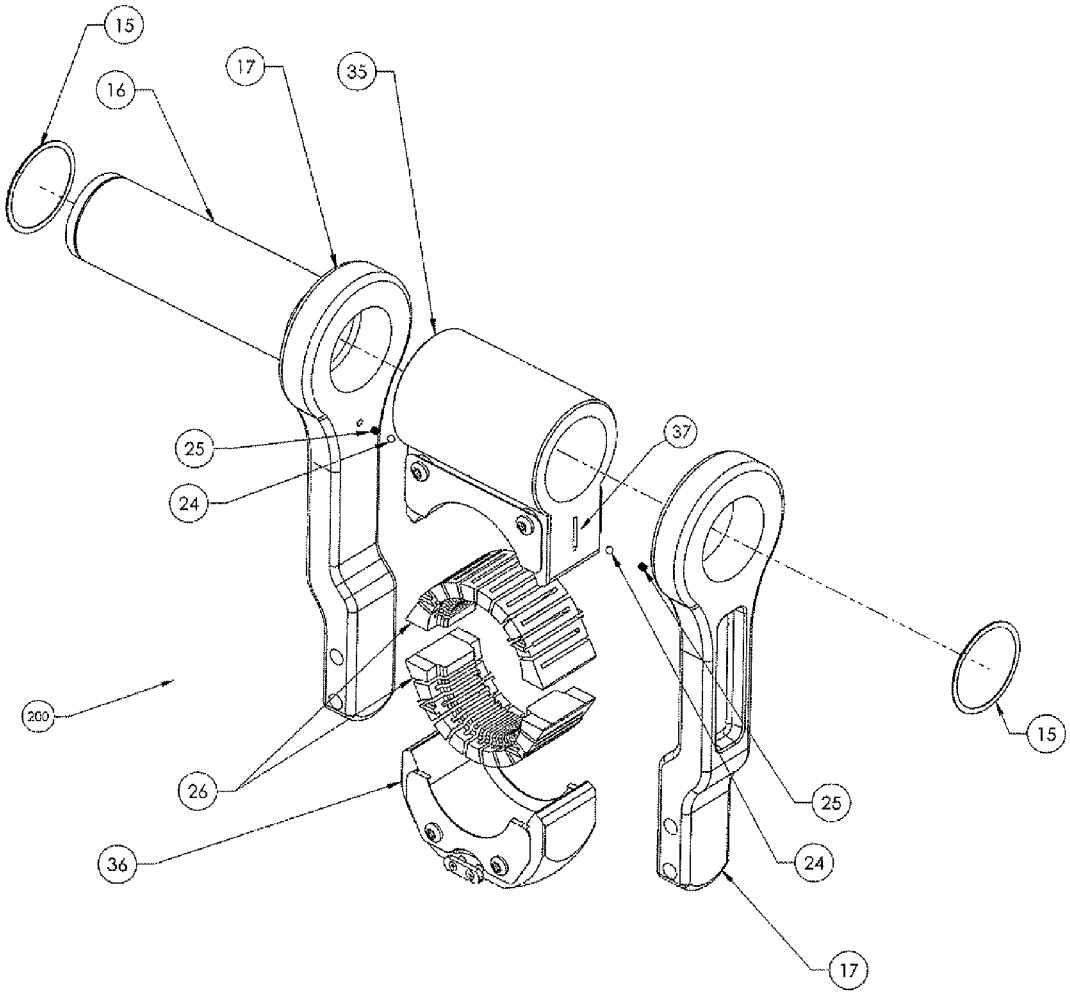
FIG. 2 is an exploded perspective view of a head assembly portion of a swage tool.
Figure 3:
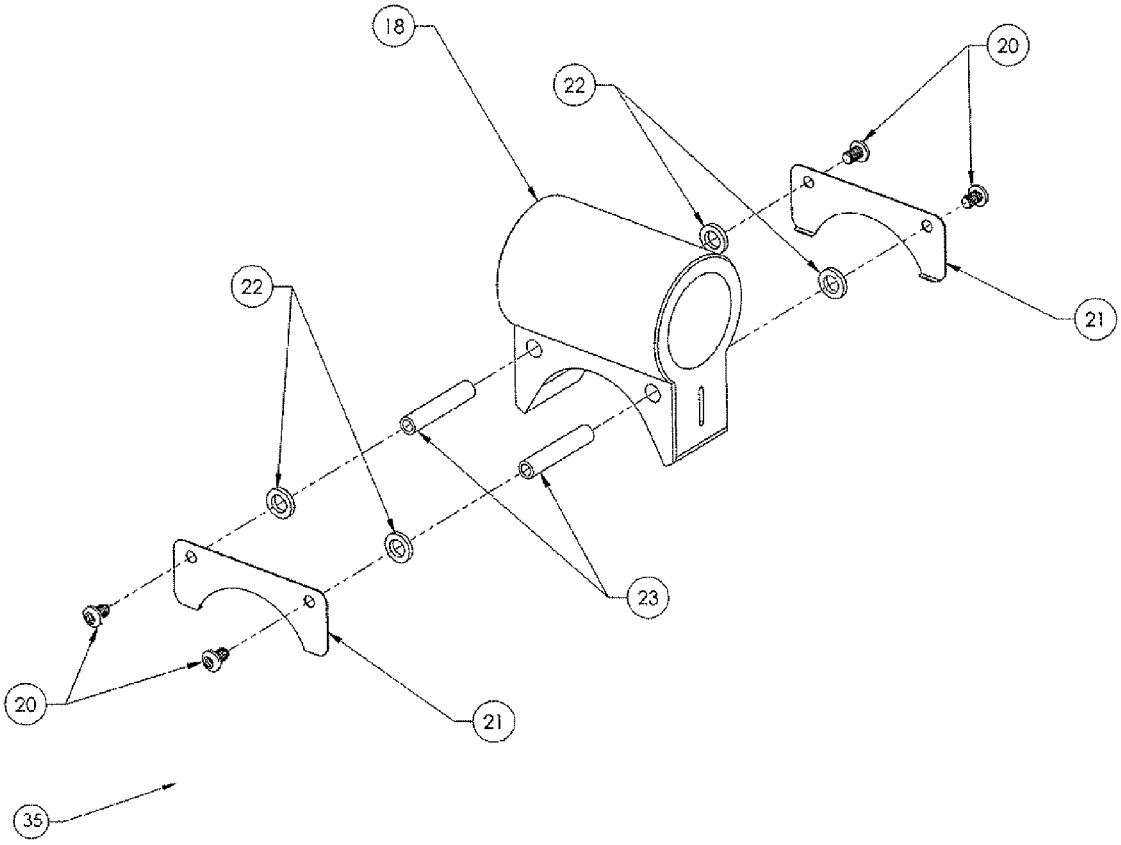
FIG. 3 is an exploded perspective view of the of an upper die block assembly of a swage tool.
Figure 4:
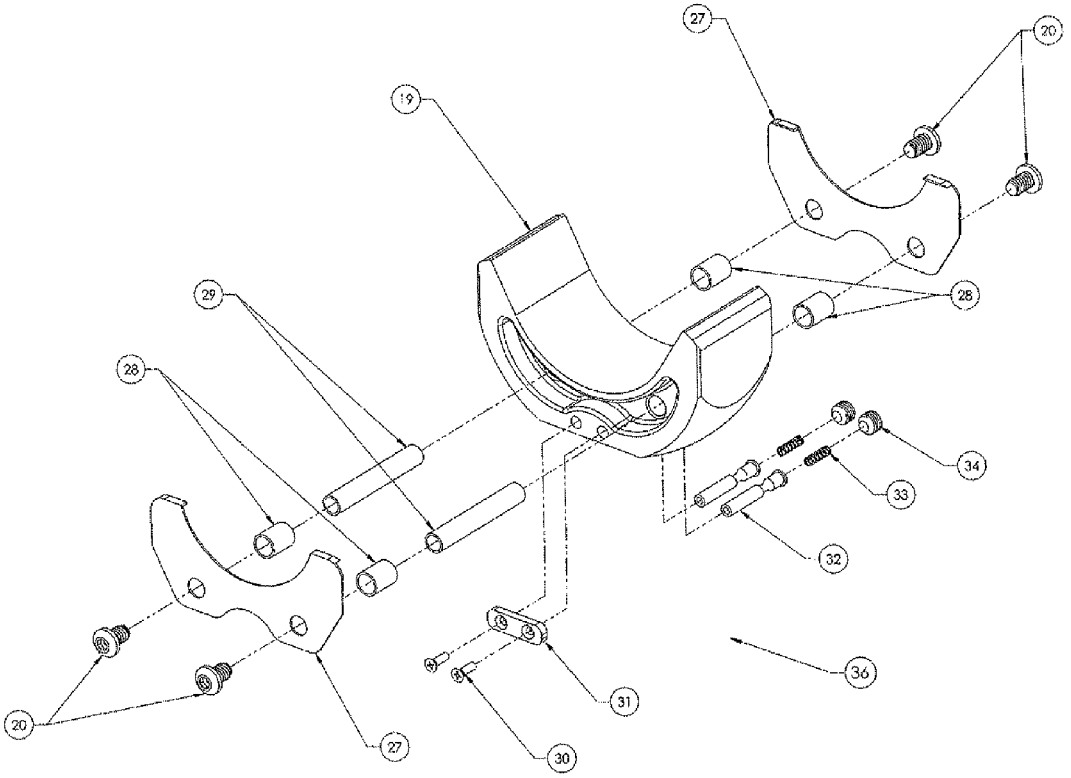
FIG. 4 is an exploded perspective view of the of a lower die block assembly of a swage tool.

Head assembly portion 200 illustrated in FIGS. 2-4 is now described in detail. Upper first die block assembly 35 holds upper swage die 26 while lower second die block assembly 36 holds lower swage die 26. Upper first die block 18 holds the swage die through upper first die retaining plate 21 (FIG. 3). Similarly, second die block assembly 36 holds the swage die through lower second die retaining plate 27 (FIG. 4). Each of the dies can include slots extending inwardly from either end to allow radial compression of the dies. A pair of upper retaining dowels 23 are provided through corresponding holes in upper die block 18 to connect the two halves of upper first die retaining plate 21. On both sides of dowel 23, upper spacers 22 are provided between dowels 23 and plate 21. End plate screws 20 are provided to secure plate 21 to die block 18. FIG. 4 depicts a similar configuration for lower die block 19. A pair of lower retaining dowels 29 are provided through corresponding holes in lower die block 19 to connect the two halves of lower second die retaining plate 27. On both sides of dowel 29, lower spacers 28 are provided between dowels 29 and plate 27. End plate screws 20 are provided to secure plate 27 to die block 19. Each of the plates includes a tabbed portion configured to hold swage die 26 in place. This configuration allows the swage dies to be secured to the die blocks without threads, thereby eliminating stress. Furthermore, the plates may be easily switched in order to accommodate differently sized swage dies. Lower die block 19 may be formed of titanium in order to increase strength while reducing weight over a steel die block.

Figure 8:
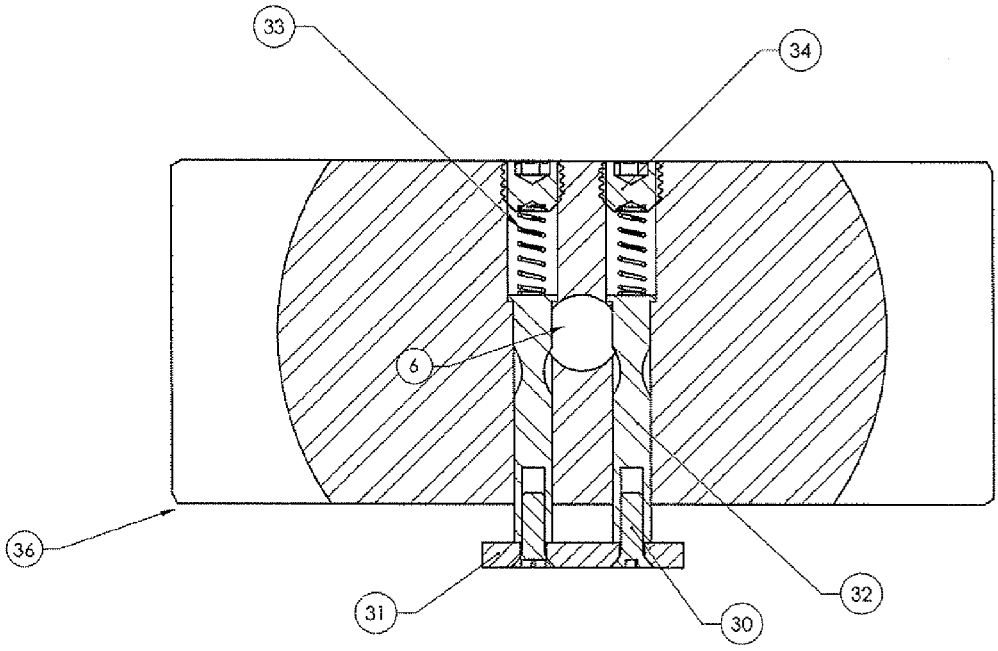
FIG. 8 is a cross-sectional plan view of the connecting portion of the lower die block assembly.

Lower die block 19 includes a connecting portion to couple die block 19 to cylinder assembly portion 100. The connecting portion includes elements 30-34 as well as an interior cavity within die block 19 that accommodates the insertion of a portion of upper piston 6. The connecting portion is provided on an underside of die block 19. FIG. 8 is a cross-sectional plan view of the connecting portion of lower die block assembly 36. A set of release pins 32 are moved between open and closed positions. The closed position is shown in FIG. 8. Release screws 30 connect release plate 31 to release pins 32. Release springs 33 are provided between pins 32 and set screws 34. Pins 32 and springs 33 are secured within die block 19 on one side by plate 31 and screws 30, and on the opposite side with screws 34. Screws 34 secure the connecting portion within die block 19.

When a user applies force to release plate 31, pins 32 are moved towards screws 34 to allow insertion of piston 6 into block 19. Pins 32 include indentations that are sized to allow the tip of upper piston 6 to be inserted when pins 32 are pushed towards screws 34. In FIG. 8, pins 32 include a set of semi-circular indentations that match the circumference of the tip of upper piston 6. If the connecting portion is in the closed position, the tip of the piston will not pass through the pins. However, in the open position, the gap between pins 32 will be just wide enough to allow insertion of piston 6 into the interior cavity of die block 19. Once inserted, release of push plate 31 moves pins 32 to a closed position where piston 6 cannot fail out of die block 19. The cross-sectional views of FIGS. 5*a* and 5*b* show an uppermost portion of piston 6 held in an interior cavity of second die block 19 by a pair of release pins 32. The movement of upper piston 6 pushes the swage dies closer together while maintaining the connection between piston 6 and second die block 19.

FIG. 2 is an exploded perspective view of the entire head assembly portion 200. In addition to first and second die blocks 35, 36 and swage dies 26, head assembly portion 200 includes first and second arms 17 that secure first die block 35 to cylinder 4. Main pin 16 is inserted through the first arm, first die block and second arm to couple those parts to each other. Main pin 16 is secured by a pair of snap rings 15. First die block 35 includes a cylindrical portion sized to fit over main pin 16 where main pin 16 is inserted through the cylindrical portion. The first arm is coupled to the second arm via first die block 35. First die block 35 and one of the arms 17 rotate independently about the main pin, which is to say they rotate about the longitudinal axis of first die block 35. The rotation of first die block 35 is an unrestricted 360 degrees. One end of the arm includes a hole for the insertion of either a quick-release pin 3 or bracket pin 2. The other end of the arm includes a hole for main pin 16. A middle section of the arm can include an opening that reduces the amount of material and weight of the arm to reduce the overall material and weight of the tool. Arms 17 further include a ball detent 24 and spring 25 configuration provided closer towards the main pin hole. First die block 35 includes a pair of corresponding grooves 37 that are sized and positioned to accept ball detent 24. When either first die block 35 or arm 17 is rotated so that ball detent 24 falls into the corresponding groove 37, arm 17 and first die block 35 are locked into place together. When locked, the arm and die block will not freely rotate with respect to each other. However, a user can apply enough force to force ball detent 24 out of groove 37 to again allow arm 17 or first die block 35 to rotate about main pin 16. This locking mechanism provides tactile feedback that arms 17 and first die block 35 are locked into place. When first die block 35 is locked to both arms via the ball detents, first die block 35 will not rotate about main pin 16 when swaging is performed. Main pin 16 may be formed of a combination of titanium on the exterior and an aluminum interior to further reduce the weight. First die block 35 may be formed from steel.

The process of assembling the swage tool is described below. At rest, the connecting position is provided in the closed position where release plate 31 and release pins 32 protrude out from second die block 19. An open position is formed when a user pushes in release plate 31. While maintaining the open position, the user is able to slide the tip of upper piston 6 between the semi-circular indentations in release pins 32 and slide the tip of upper piston 6 into an interior space of second die block 19. When the user releases pressure on release plate 31, release pins 32 slide back into the closed position and lock upper piston 6 to second die block 19. Piston 6 is secured between the set of pins 32 in the closed position. In this manner, a user is able to attach and separate head assembly portion 100 from cylinder assembly portion 200 quickly and without the need for specialized tools or complex parts. The open position allows insertion of the cylinder into the die block and the closed position secures the inserted cylinder within the die block. Therefore, second die block 19 sits above cylinder 4 and is attached to upper piston 6 through the connecting portion to securely attach cylinder 4 to die block 19. An internal locking mechanism is thus provided to engage the upper piston and die block.

Figure 6A:
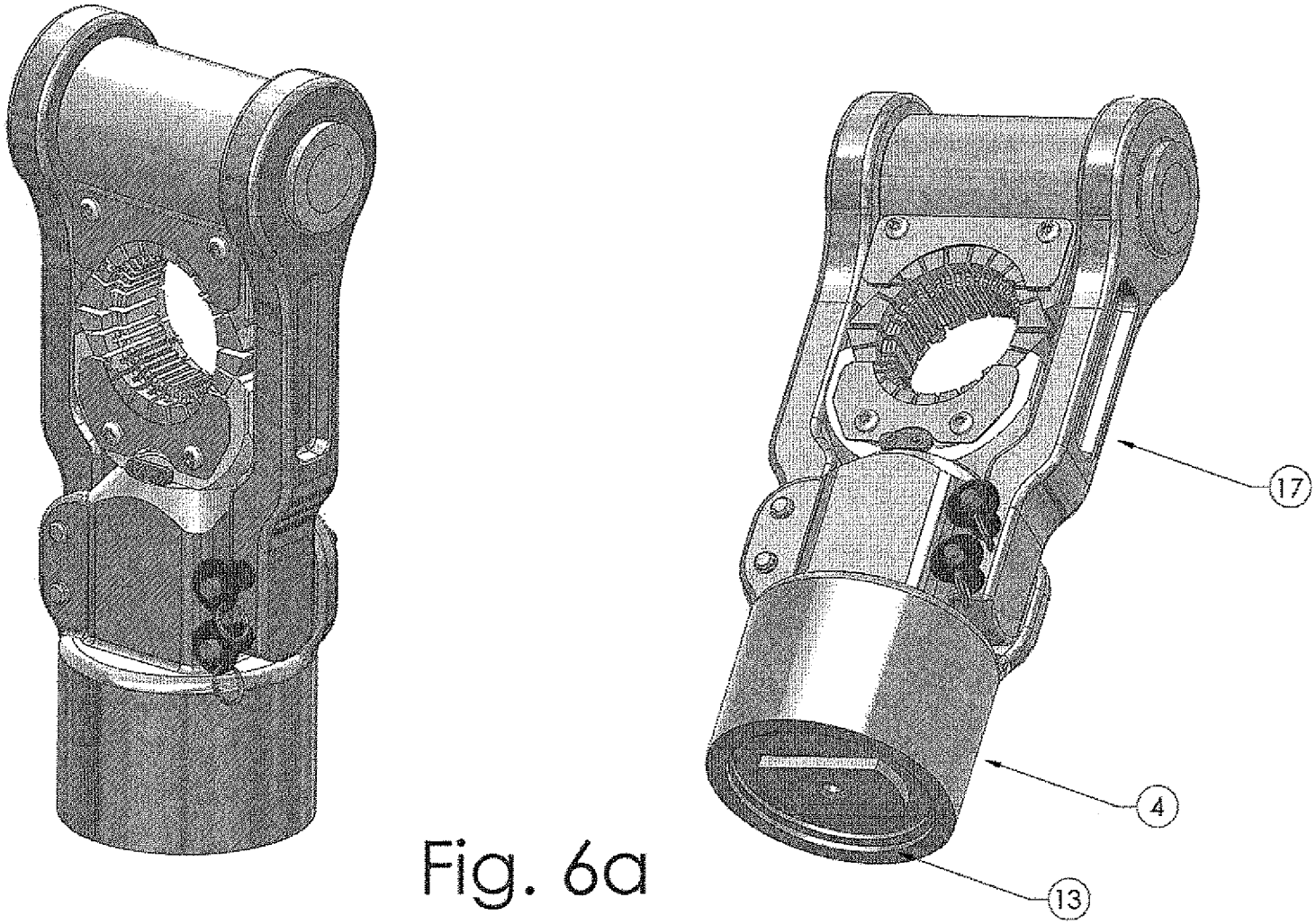
FIG. 6*a* provides perspective views of the swage tool in an unswaged position.
Figure 6B:
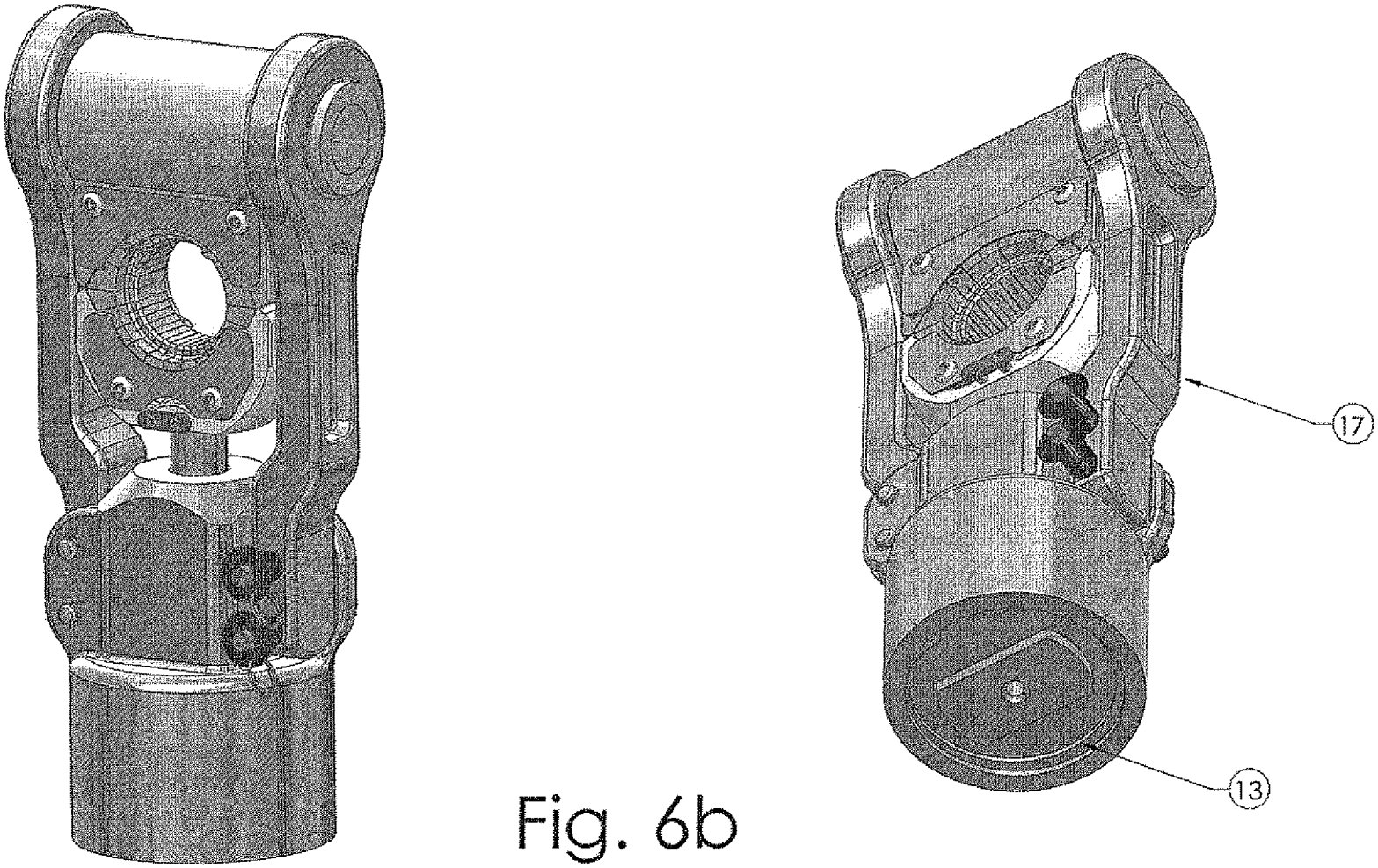
FIG. 6*b* provides perspective views of the swage tool in a swaged position.
Figure 7A:
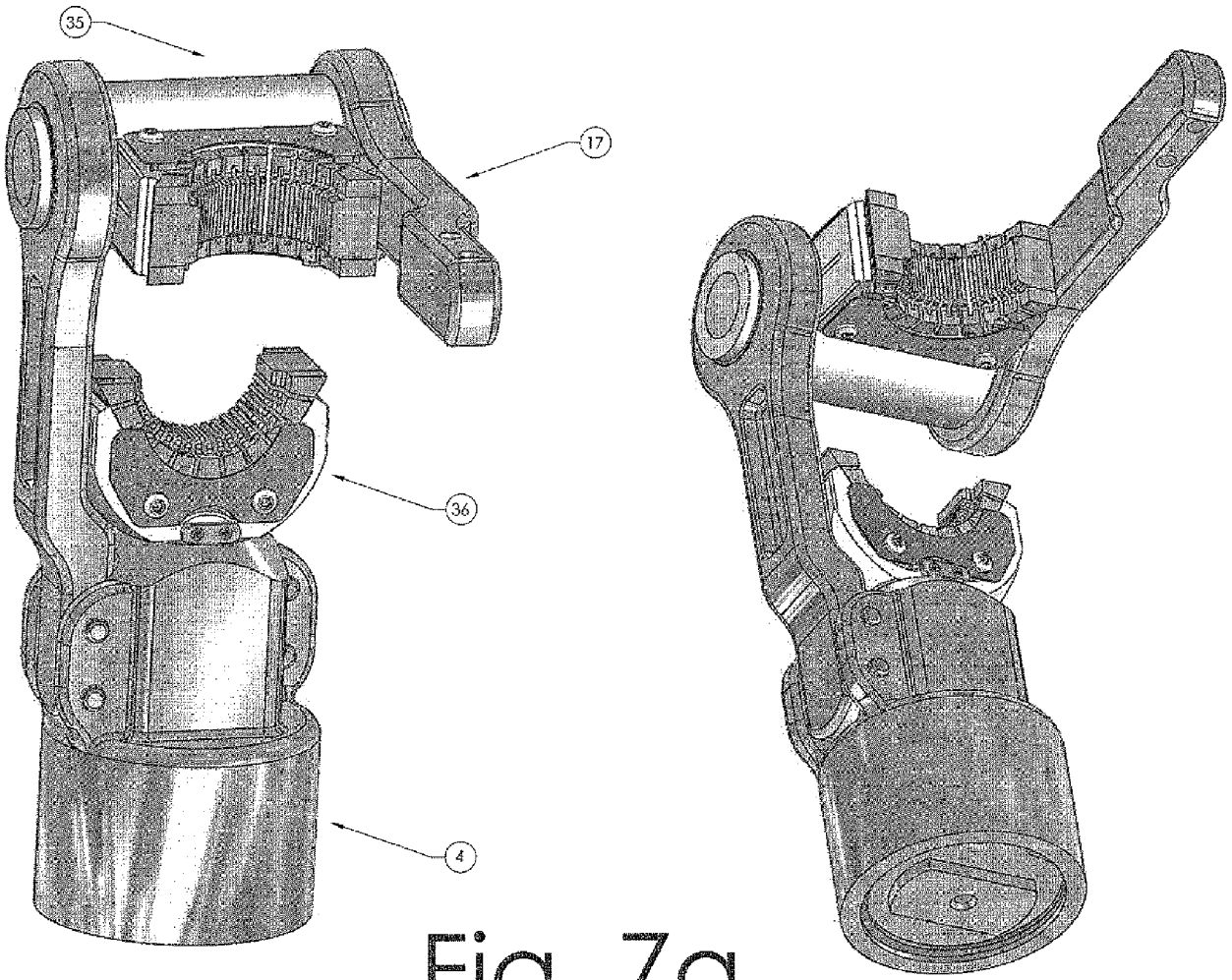
FIG. 7*a* provides perspective views of the swage tool in a swung open position.
Figure 7B:
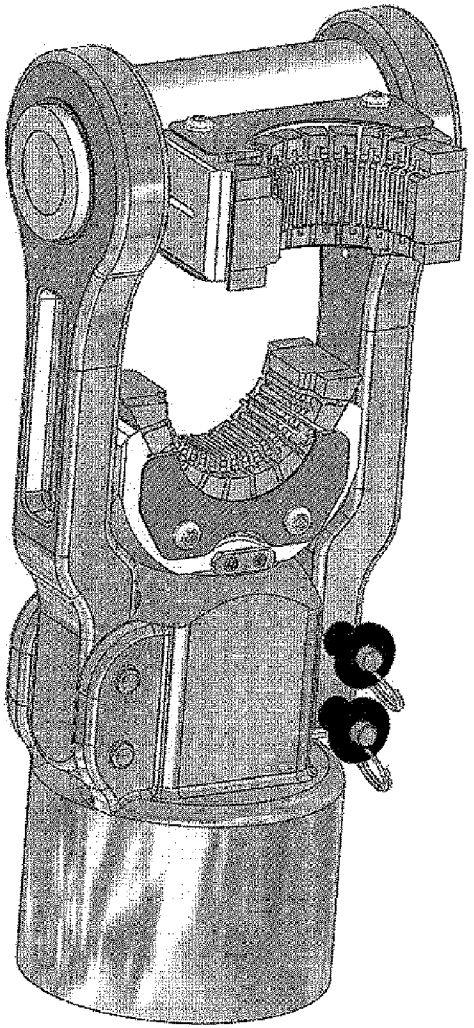
FIG. 7*b* provides perspective views of the swage tool in another swung open position.
Figure 7B:
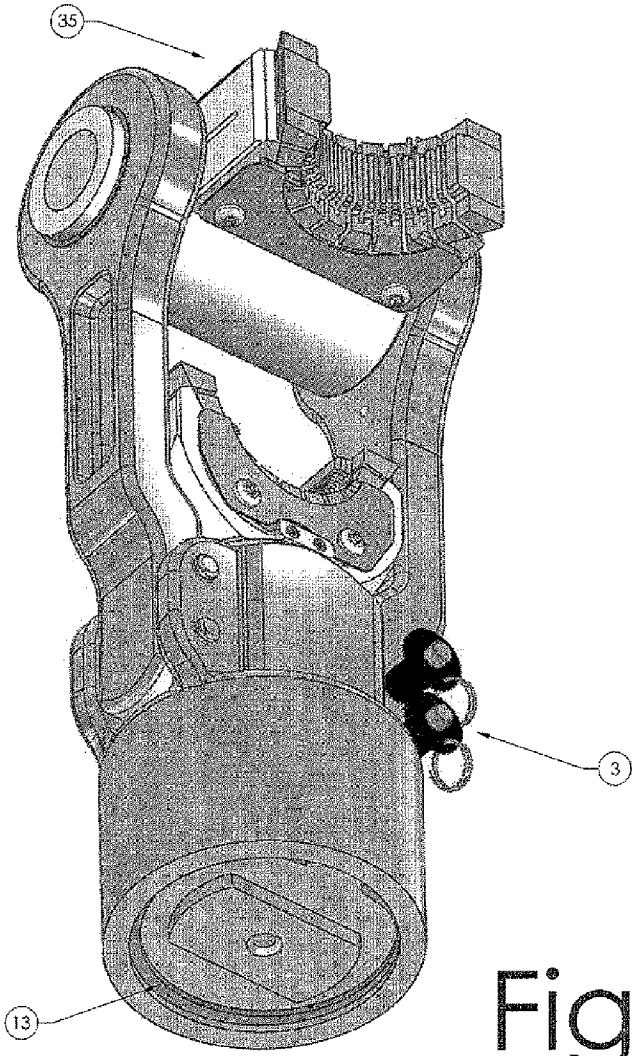

Next, with respect to FIGS. 1-8, first arm 17 is coupled to attachment portions 40 of cylinder 4. A pair of attachment portions 40 sandwich first arm 17 and are secured together by bracket pins 2 and snap rings 1. In FIGS. 5-7, the first arm and bracket pins 2 are provided on the left side of cylinder 4. Bracket pins 2 ensure that first die block 35 is securely coupled to the cylinder even if second arm 17 is not attached to cylinder 4. More than two pins may be utilized to secure the arms. While first die block 35 and second arm 17 are able to freely rotate about main pin 16, the first arm is fixed to cylinder 4. FIGS. 7*a* and 7*b* show different swung open positions where the first arm is coupled to attachment portions 40 of cylinder 4 while head 35 and second arm 17 rotate about a longitudinal axis of first die block 35. Head 35 and second arm 17 swing independently of each other. Having the ability to swing open the head and second arm 17 allows a user to easily insert or remove a workpiece to be swaged in difficult swaging areas such as in trenches. The rotation of first die block 35 is unrestricted while second arm 17 is restricted in its movement only by the single attachment portion 40 in its rotation arc. FIGS. 6*a* and 6*b* provide different perspective views of the swage tool in unswaged and swaged positions.

Next, the user can rotate head 35 or second arm 17 into a swaging position. In FIG. 7*b*, the second arm is rotated into a locked position while head 35 is provided at approximately 90 degree angle with respect to the arms. A pair of quick-release pins 3 are inserted through second arm 17 and attachment portion 40 to secure the second arm to the cylinder. Quick-release pins 3 prevent undesirable rotation and movement of the second arm and head while also allowing a quick release, as opposed to a configuration where screws or threaded bolts are used in place of the pins. Accordingly, the inventive swinging head swage tool advantageously allows objects to be quickly inserted and removed from a swage tool. The operator can also quickly determine if the swage tool is secured by simply examining the position of the pins and the head. Thus, the present invention provides greater flexibility in the operation of a swage tool.

After second arm 17 is swung closed and secured with quick-release pins 3 (FIG. 7*b*), head 35 can be swung closed into the locked position where ball detents 24 fall into corresponding grooves 37 of first die block 35 (FIGS. 5*a*, 6*a*). The user can both feel and hear ball detents 24 click into the grooves to confirm that first die block 35 is locked into place. FIGS. 5*a* and 5*b* illustrate side views and cross-sectional views of the swage tool in unswaged and swaged positions. The workpiece is not shown for clarity. The unswaged position (FIGS. 5*a*, 6*a*) is the configuration where pins 3 are secured through the corresponding holes in attachment portion 40 and where spring 5 is uncompressed. The swaged position (FIGS. 5*b*, 6*b*) is the configuration where pistons 6 and 11 are pushed upwards to compress spring 5 and raise second die block 36 such that the upper and lower portions of swage die 26 are brought closer together. Alternatively, head 35 can be swung into a locked position before swinging second arm 17 into locked position.

FIGS. 9-13 illustrate another embodiment of a swinging head swage tool for swaging a fitting to join tubes together. The swinging head swage tool includes cylinder assembly portion 300 and head assembly portion 400. Where not described in detail below, elements designated by the same reference numerals as described above are the same as those elements described above.

Figure 9:
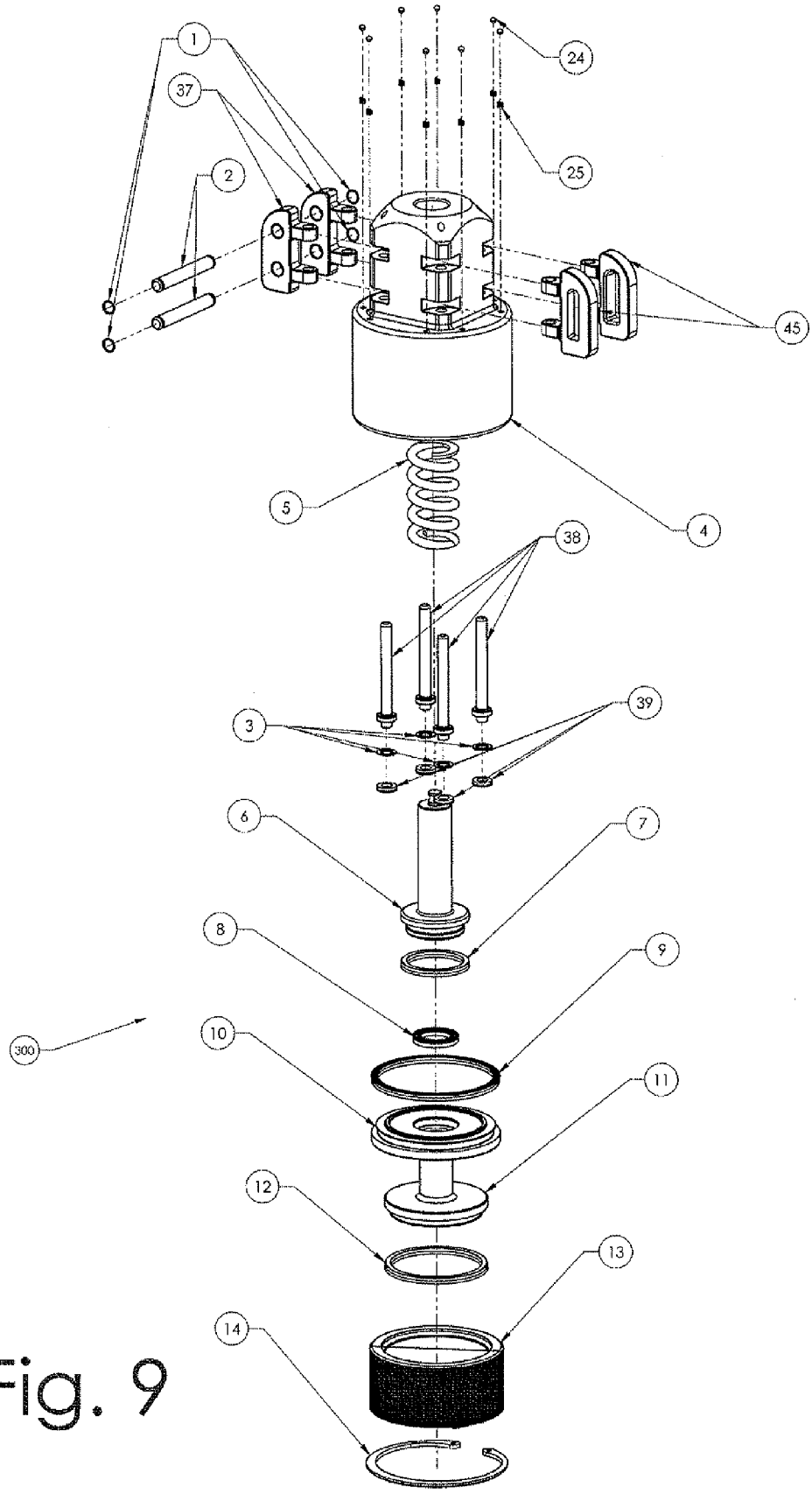
FIG. 9 is an exploded perspective view of a cylinder assembly portion of another swage tool according to the invention.

FIG. 9 is an exploded perspective view of cylinder portion 300. Cylinder 4 houses elements 5-14, 38 and 39. Cylinder 4 is scalable for different-sized pistons and to allow arms 17 to be provided closer to or farther from each other. Cylinder 4 compresses a pair of dies 26 toward each other to swage a workpiece therebetween. A set of fixed swinging tabs 37 and locking swinging tabs 45 are provided on the exterior of cylinder 4 to secure first and second arms to cylinder 4. Tabs 37 and 45 protrude out from cylinder 4 and include holes for insertion of either bracket pins 2 or insert tab lock 43 into the tabs. Pins 2 and tab lock 43 secure tabs 37 and 45 in place, and thus secure cylinder assembly portion 300 to head assembly portion 400.

Each of tabs 37 and 45 are attached to cylinder 4 in a manner such that each tab may rotate, or swing, about a longitudinal axis of cylinder 4. In particular, each tab 37 and 45 rotates about a corresponding swing tab pin 38 used to secure tabs 37 and 45 to cylinder 4. Tabs 37 and 45 are secured to cylinder 4 by pins 38. A set of springs 25 and ball detents 24 along a circumference of cylinder 4 secure the tabs in place at predetermined positions, such as a locked position (FIG. 13*a*) and an unlocked position (FIG. 13*b*) in a similar manner to that described with respect to FIG. 2. Cylinder 4 and tabs 37 and 45 each include holes for insertion of pins 38 separate from the holes for insertion of pin 2 and tab lock 43. Pins 38 are further secured to cylinder 4 using ring 3 and seal 39.

Spring 5 is provided over upper piston 6 and compresses and expands based on movement of upper piston 6. Upper piston 6 is slid through the center of spring 5 and the uppermost hole in cylinder 4 in order to couple with and push up second die block assembly 36 (FIG. 10) between unswaged and swaged positions (FIGS. 11*a* and 11*b*). Upper piston 6 includes on its bottom surface upper piston seal 7. Cylinder 4 is divided into upper and lower chambers by divider 10. Divider 10 includes divider seal 9. Upper piston 6 is a rod that slidably extends through the bore of cylinder 4 for connection to second die block 36. Lower piston 11 moves within the lower chamber and slidably extends through a bore in divider 10 so as to abut upper piston 6. The two pistons are biased to return position by spring 5. The pair of pistons within cylinder 4 moves lower second die block assembly 36 towards upper first die block assembly 35 to swage the workpiece.

At an unswaged position (FIG. 11*a*), upper piston 6 sits above divider 10. Divider 10 is formed with rod seal 8 and divider seal 9 provided around a circumference of divider 10 (FIG. 9). Threaded bottom cap 13 is provided below divider 10 and is screwed into the bottom of cylinder 4 along with snap ring 14. Lower piston 11 includes lower piston seal 12 and moves up and down through a hole in divider 10 to move upper piston 6, which in turn moves dies 26 closer together.

A first arm is configured to be semi-permanently attached to cylinder 4 through the set of bracket pins 2 and retaining rings 1 coupled to the set of swinging tabs 37. The first arm is considered semi-permanently attached in the sense that under normal operation, pins 2 are not removed from tabs 37 since tabs 45 are more easily unlocked from arm 17 instead. Tabs 45 are easily opened and closed through rotation by hand without any tools so as to allow the user to unlock and quickly rotate second arm 17. When locked in placed, tabs 45 are provided on opposite sides of second arm 17. A user is able to snap open or closed tabs 45 from both sides of second arm 17. By contrast, pins 2 are secured through first arm 17 and tabs 37 by snap rings 1. Bracket pins 2 are not so easily removed by hand and are meant to ensure secure coupling between cylinder 4 and first arm 17.

Figure 10:
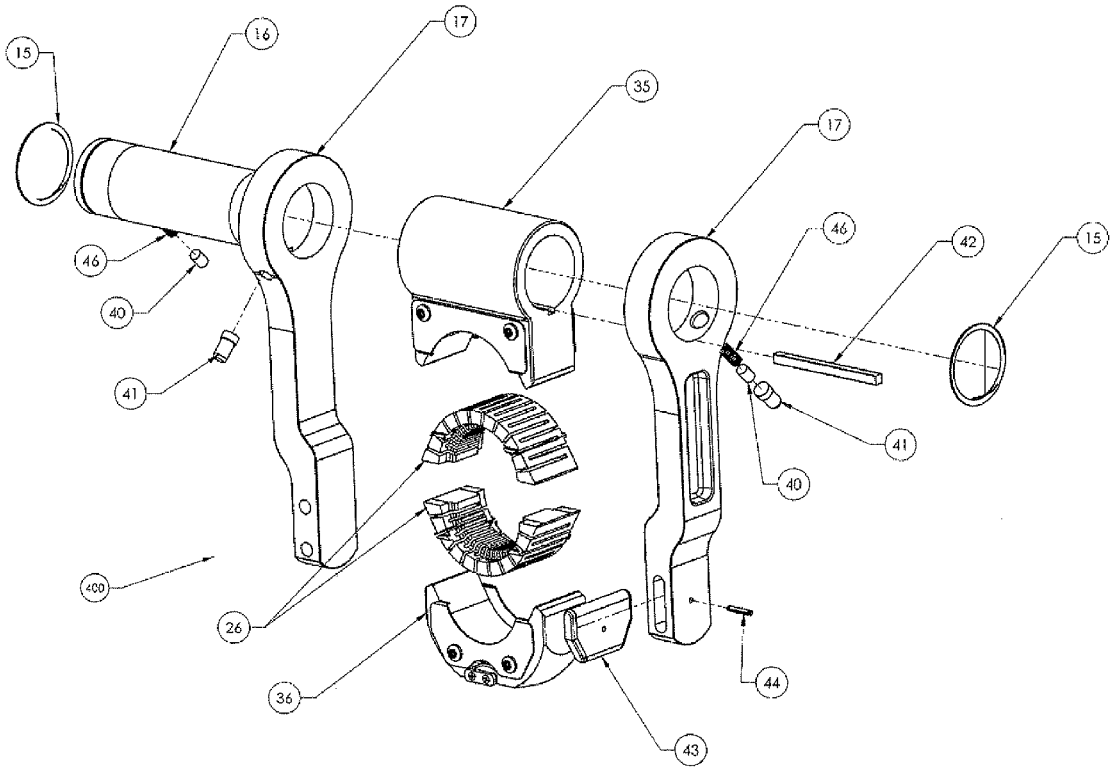
FIG. 10 is an exploded perspective view of a head assembly portion of another swage tool.
Figure 11A:
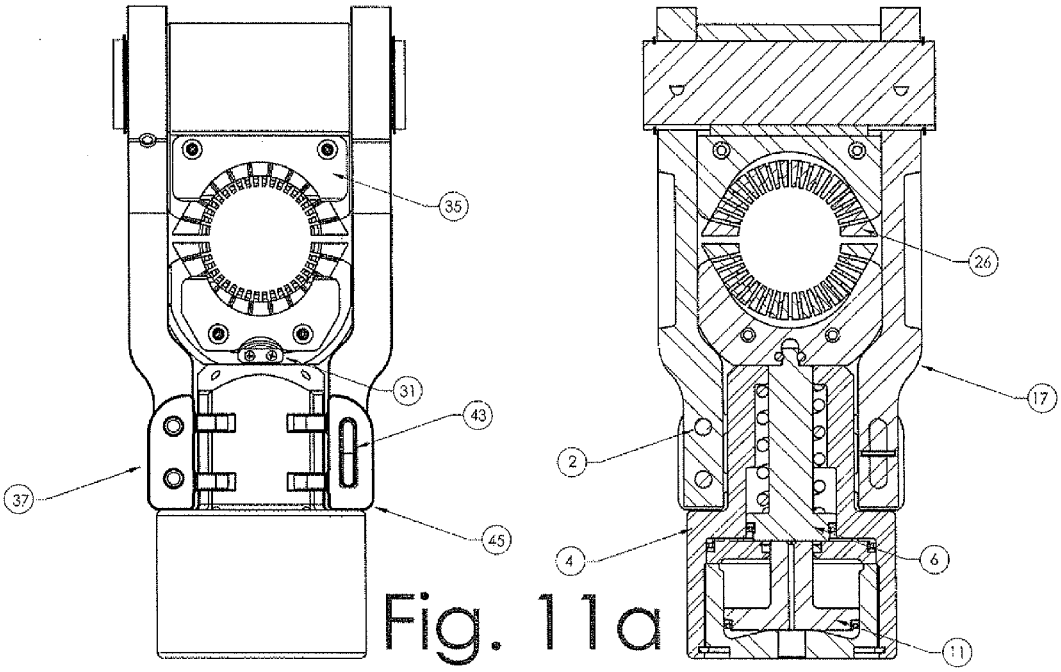
FIG. 11*a* is a side and cross-sectional view of another swage tool in an unswaged position.
Figure 11B:
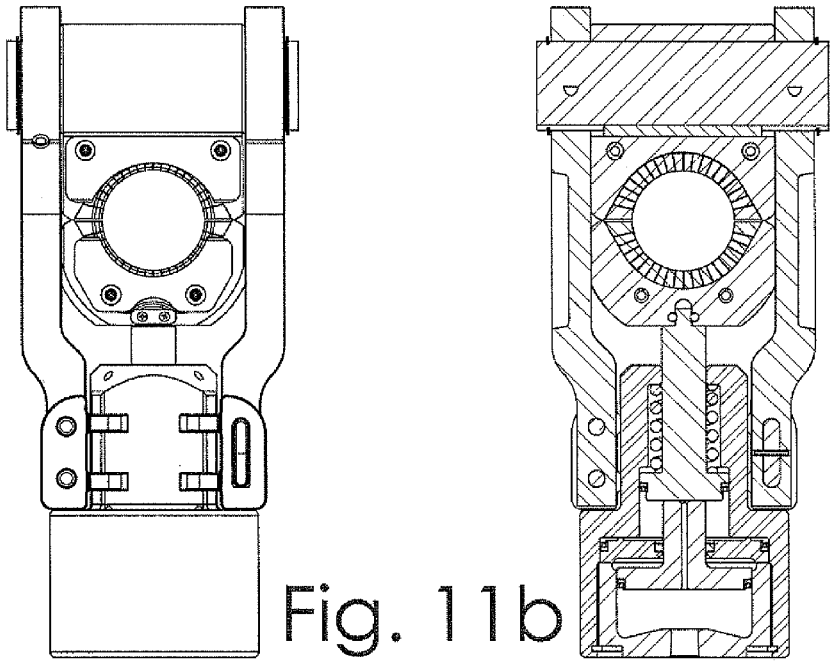
FIG. 11*b* is a side and cross-sectional view of another swage tool in a swaged position.

Head assembly portion 400 illustrated in FIGS. 3, 4 and 10 is now described. In FIG. 10, upper first die block assembly 35 holds upper swage die 26 while lower second die block assembly 36 holds lower swage die 26. Lower die block 19 (FIG. 4) includes a connecting portion to couple die block 19 to cylinder assembly portion 300. The connecting portion includes elements 30-34 as well as an interior cavity within die block 19 that accommodates insertion of a portion of upper piston 6. The connecting portion is provided on an underside of die block 19, as illustrated in FIG. 8.

FIG. 10 is an exploded perspective view of the entire head assembly portion 400. In addition to first and second die blocks 35, 36 and swage dies 26, head assembly portion 400 includes first and second arms 17 that secure first die block 35 to cylinder 4. Main pin 16 is inserted through the first arm, first die block and second arm to couple those parts to each other. Main pin 16 is secured by a pair of snap rings 15. First die block 35 includes a cylindrical portion sized to fit over main pin 16 where main pin 16 is inserted through the cylindrical portion. The first arm is coupled to the second arm via first die block 35. First die block 35 and one of the arms 17 rotate about the main pin, which is to say they rotate about the longitudinal axis of first die block 35. One end of the arm includes a hole for main pin 16. A middle section of the arm can include an opening that reduces the amount of material and weight of the arm to reduce the overall material and weight of the tool. The other end of the arm includes a hole for insertion of a bracket pin 2 or for insert tab lock 43. The opening in swinging tab 45 accepts insert tab lock 43. Tab lock 43 protrudes out from second arm 17 to lock into the hole within tabs 45 to secure second arm 17 to cylinder 4. Tab lock retaining pin 44 is inserted into arm 17 and tab lock 43 to secure those components together. Key stock 42 is provided along the length of first die block 35 within a corresponding groove.

Figure 12A:
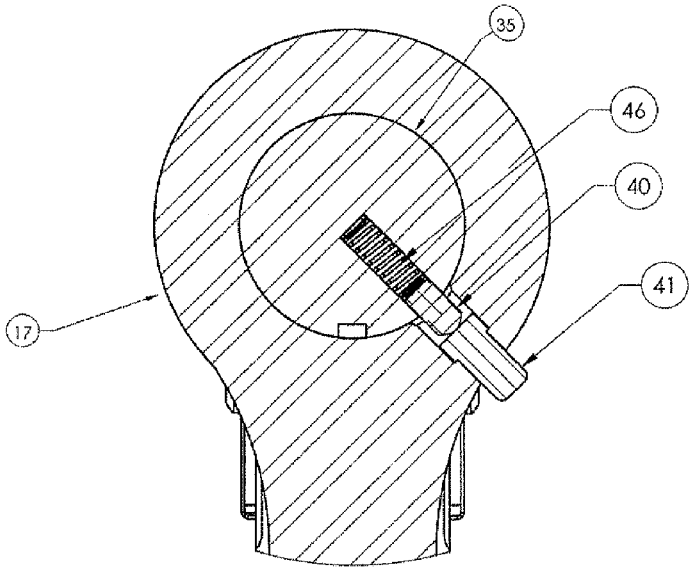
FIG. 12*a* is a cross-sectional view of the locking mechanism of another swage tool in a locked position.
Figure 12B:
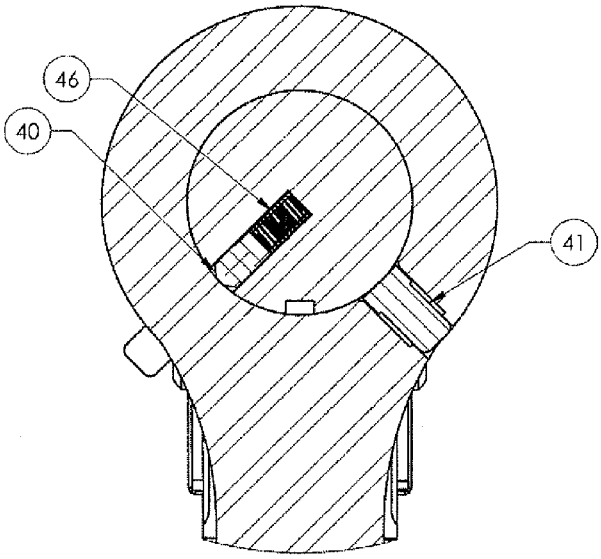
FIG. 12*b* is a cross-sectional view of the locking mechanism of another swage tool in an unlocked position.
Figure 13A:
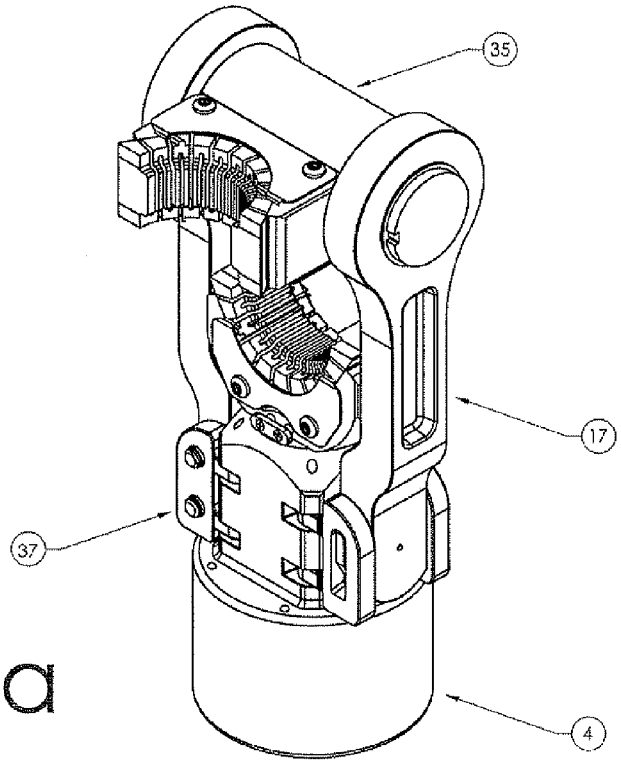
FIG. 13*a* provides a perspective view of the swage tool in a locked position.
Figure 13B:
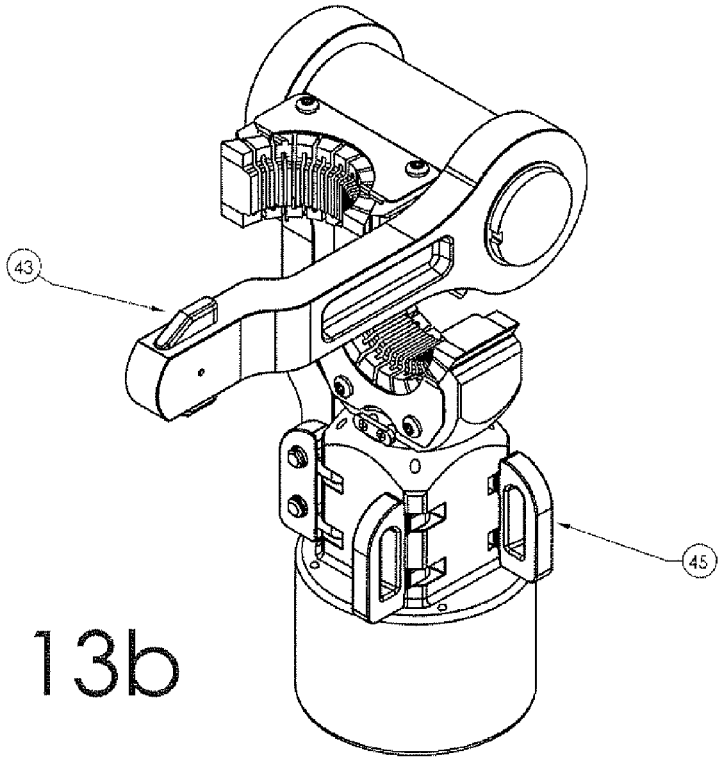
FIG. 13*b* provides a perspective view of the swage tool in a swung open position.

Locking ram 40, push pin 41 and locking spring 46 are provided within each of the two arms and first die block 35 to lock the arms and first die block 35 into place with respect to each other. In FIG. 10, push pins 41 are provided within arms 17 on opposite sides of the die block in order to provide different locking positions, as discussed further below. FIG. 12*a* illustrates a cross-section of second arm 17 and upper die block assembly 35 including the positions of push pin 41, ram 40 and spring 46 in a locked position. In the position shown in FIG. 12*a*, the movement of arm 17 and die block 35 is locked together such that if arm 17 swings, the die block will swing in unison with the arm. For example, FIG. 13*b* shows second arm 17 locked together with first die block 35 such that any movement by arm 17 will induce first die block 35 to move as well. However, when push pin 41 is pressed inward, then the second arm and die block may be moved independently of each other until they are rotated back into a locking position where spring 46 pushes locking ram 40 into push pin 41. FIG. 12*b* illustrates the push pin locking mechanism within first arm 17 and assembly 35 that operates similarly to the push pin in the second arm, but is provided on an opposite side of the die block (FIG. 2). In FIG. 12*b*, the unlocked position of first arm 17 is shown that allows the die block to move independently of the first arm. FIG. 13*a* illustrates the locked position of first arm 17 and first die block 35. These two locking mechanisms allow an item to be easily manipulated between dies 26 before and after swaging.

The process of assembling the swage tool for the second embodiment is described below. At rest, the connecting position is provided in the closed position where release plate 31 and release pins 32 protrude out from second die block 19. An open position is formed when a user pushes in release plate 31. While maintaining the open position, the user is able to slide the tip of upper piston 6 between the semi-circular indentations in release pins 32 and slide the tip of upper piston 6 into an interior space of second die block 19. When the user releases pressure on release plate 31, release pins 32 slide back into the closed position and lock upper piston 6 to second die block 19. Piston 6 is secured between the set of pins 32 in the closed position. In this manner, a user is able to attach and separate head assembly portion 300 from cylinder assembly portion 400 quickly and without the need for specialized tools or complex parts. The open position allows insertion of the cylinder into the die block and the closed position secures the inserted cylinder within the die block. Therefore, second die block 19 sits above cylinder 4 and is attached to upper piston 6 through the connecting portion to securely attach cylinder 4 to die block 19. An internal locking mechanism is thus provided to engage the upper piston and the die block.

In the embodiment of FIGS. 9-13, tabs 37 and 45 are secured to cylinder 4 using pins 38, but pins 38 may rotate or swing about cylinder 4. Then, first arm 17 is coupled to the pair of swinging tabs 37 of cylinder 4. Tabs 37 sandwich first arm 17 and are secured together by bracket pins 2 and snap rings 1. In FIGS. 10, 11 and 13, the first arm and bracket pins 2 are provided on the left side of cylinder 4. Bracket pins 2 ensure that first die block 35 is securely coupled to cylinder 4 even if second arm 17 is not attached to cylinder 4. More than two pins may be utilized to secure the arms. While first die block 35 and second arm 17 are able to freely rotate about main pin 16, the first arm is fixed to cylinder 4. In FIG. 13*b*, the first arm is locked with respect to first die block 35 such that pin 41 of the first arm protrudes from the arm. Similarly, second arm 17 is locked to first die block 35 such that pin 41 of second arm 17 protrudes form the arm (not shown). FIG. 13*b* shows a swung open position where the first arm is coupled to tabs 37 while die block 35 and second arm 17 are rotated into an open position. The ability to swing open and lock the first arm, die block and second arm in place allows a user to easily insert or remove a workpiece to be swaged in difficult swaging areas such as in trenches. Therefore, a user need not physically hold open the arm with one hand while inserting or removing a workpiece with another hand, and can simply swing open the second arm and die block into a locked position.

Next, the user pushes in pin 41 of the second arm to unlock the second arm from the die block and swings the second arm into a closed position. Then, in order to secure the second arm to cylinder 4, swing tabs 45 are swung closed, as shown in FIG. 13*a*. Die block 35 will remain in the locked position shown in FIG. 13*a* until the push pin of the first arm is depressed to unlock the die block from the first arm, at which point the die block may be rotated into the closed position, as shown in FIG. 11*a*. Alternatively, die block 35 can be swung into the closed position before swinging closed second arm 17 by depressing both push pins at once. Accordingly, the inventive swinging head swage tool advantageously allows objects to be quickly inserted and removed from a swage tool. The operator can also quickly determine if the swage tool is secured by simply examining the position of the push pins and tabs. Thus, the present invention provides greater flexibility in the operation of a swage tool.

FIGS. 11*a* and 11*b* illustrate side views and cross-sectional views of the swage tool in unswaged and swaged positions. The workpiece is not shown for clarity. The unswaged position (FIG. 11*a*) is the configuration where the arms are swung closed and secured through the corresponding tabs and where spring 5 is uncompressed. The swaged position (FIG. 11*b*) is the configuration where pistons 6 and 11 are pushed upwards to compress spring 5 and raise second die block 36 such that the upper and lower portions of swage die 26 are brought closer together.

The invention provides a swinging head swage tool that is versatile and compact in design and further allows insertion of a workpiece in multiple ways. The invention is also simple to operate, reliable and easy to service. The swage tool ensures proper connection, alignment and orientation of the upper die with the lower die and provides superior ease of use and assembly. Components of the tool are also much lighter and smaller than conventional swage tools. Assembly of the tool is made easier using the connecting portion and the quick-release pins such that the number of people necessary to operate the tool is reduced.

The embodiments of the invention described in this document are illustrative and not restrictive. Modification may be made without departing from the spirit of the invention as defined by the following claims.

The invention claimed is:

1. A swage tool, comprising:

a first die block;

a second die block;

a first die coupled to a portion of the first die block;

a second die coupled to a portion of the second die block; and a cylinder that moves the second die toward the first die along a first axis, wherein the first die block rotates about a longitudinal axis of the first die block, and the longitudinal axis is perpendicular to and intersects the first axis.

2. The swage tool according to claim 1, further comprising:

a first arm and a second arm coupling the first die block to the cylinder; and a set of pins inserted though the cylinder and the second arm to couple the first die block to the cylinder.

3. The swage tool according to claim 2, wherein the first arm is coupled to the second arm via the first die block.

4. The swage tool according to claim 2, wherein the second arm rotates about the longitudinal axis of the first die block.

5. The swage tool according to claim 4, wherein the first die block and the second arm rotate independently.

6. The swage tool according to claim 2, wherein a main pin is provided through the first arm, the second arm and the first die block.

7. The swage tool according to claim 2, wherein the first arm and the second arm include a ball detent and spring.

8. The swage tool according to claim 7, wherein the first die block includes a pair of grooves corresponding to the ball detent.

9. The swage tool according to claim 1, wherein the first die block includes a main pin inserted through a cylindrical portion.

10. The swage tool according to claim 1, wherein a piston of the cylinder is connected to a connecting portion of the second die.

11. A swage tool, comprising:

a first die block;

a second die block;

a first die coupled to a portion of the first die block;

a second die coupled to a portion of the second die block;

a cylinder that moves the second die toward the first die, wherein the first die block rotates about a longitudinal axis of the first die block;

a first arm and a second arm coupling the first die block to the cylinder; and a set of pins inserted though the cylinder and the second arm to couple the first die block to the cylinder.

12. The swage tool according to claim 11, wherein the first arm is coupled to the second arm via the first die block.

13. The swage tool according to claim 11, wherein the second arm rotates about the longitudinal axis of the first die block.

14. The swage tool according to claim 13, wherein the first die block and the second arm rotate independently.

15. The swage tool according to claim 11, wherein a main pin is provided through the first arm, the second arm and the first die block.

16. The swage tool according to claim 11, wherein the first die block includes a main pin inserted through a cylindrical portion.

17. The swage tool according to claim 11, wherein the first arm and the second arm include a ball detent and spring.

18. The swage tool according to claim 17, wherein the first die block includes a pair of grooves corresponding to the ball detent.

19. The swage tool according to claim 11, wherein a piston of the cylinder is connected to a connecting portion of the second die.

20. A swage tool, comprising:

a first die block;

a second die block;

a first die coupled to a portion of the first die block;

a second die coupled to a portion of the second die block;

a cylinder that moves the second die toward the first die, wherein the first die block rotates about a longitudinal axis of the first die block and the first die block includes a main pin inserted through a cylindrical portion.

* * * * *